US010627114B2

(12) United States Patent
Cadima

(10) Patent No.: US 10,627,114 B2
(45) Date of Patent: Apr. 21, 2020

(54) COOKTOP APPLIANCE WITH A GAS BURNER ASSEMBLY

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 175 days.

(21) Appl. No.: 15/648,537

(22) Filed: Jul. 13, 2017

(65) Prior Publication Data

US 2019/0017709 A1 Jan. 17, 2019

(51) Int. Cl.
*F24C 3/12* (2006.01)
*F24C 3/08* (2006.01)

(52) U.S. Cl.
CPC ..... *F24C 3/124* (2013.01); *F24C 3/08* (2013.01)

(58) Field of Classification Search
CPC ..... F24C 3/124; F24C 3/08
USPC ..... 431/278–281, 283–285, 354
See application file for complete search history.

(56) References Cited

U.S. PATENT DOCUMENTS 3,592,180 A * 7/1971 Kweller ..... F23D 14/04 126/214 R
5,342,192 A * 8/1994 Hirano ..... F23D 14/06 126/39 H
6,322,354 B1 11/2001 Carbone et al.
8,479,721 B2 7/2013 Graham et al.
8,845,326 B2 9/2014 Shaffer et al.
2004/0048216 A1 3/2004 Brown et al.
2006/0051718 A1* 3/2006 Kamal ..... F23D 14/06 431/354
2008/0289617 A1* 11/2008 Graham ..... F23D 14/105 126/39 E
2014/0048293 A1 2/2014 Luongo et al.
2014/0261006 A1* 9/2014 Huang ..... A47J 36/32 99/333
2014/0295357 A1 10/2014 McAfee et al.

FOREIGN PATENT DOCUMENTS

CN 1594975 B 4/2010
EP 0887590 A1 12/1998
EP 2072900 A1 * 6/2009 ..... F23D 14/02
JP 3737184 B2 1/2006
JP 2007057226 A 3/2007
JP 04595599 B2 12/2010

* cited by examiner

*Primary Examiner* — Grant Moubry
*Assistant Examiner* — Rabeeul I Zuberi
(74) *Attorney, Agent, or Firm* — Dority & Manning

(57) ABSTRACT

A cooktop appliance includes a gas burner assembly with one or more burner bodies that define a first plurality of flame ports, a first fuel chamber, a second plurality of flame ports and a second fuel chamber. A fan is coupled to the gas burner assembly such that the fan is operable to urge a flow of air into only the second fuel chamber. An operating speed of the fan is fixed such that a firing rate of the second plurality of flame ports is fixed.

11 Claims, 6 Drawing Sheets

COOKTOP APPLIANCE WITH A GAS BURNER ASSEMBLY

FIELD OF THE INVENTION

The present subject matter relates generally to cooktop appliances with gas burner assemblies, such as gas range appliances or gas stove appliances.

BACKGROUND OF THE INVENTION

Certain cooktop appliances include gas burners for heating cooking utensils on the cooktop appliances. Gas burners generally include an orifice that directs a flow of gaseous fuel into a fuel chamber. Between the orifice and the fuel chamber, the gaseous fuel entrains air, and the gaseous fuel and air mix within the fuel chamber.

Consumers frequently prefer higher output gas burners in order to speed up cooking tasks. However, the gaseous fuel flow between the orifice and the fuel chamber has a practical limit with regards to available energy for mixing the gaseous fuel and air for clean combustion. One option to improve gas burner energy output is to add a fan to increase air flow into the fuel chamber relative to only entraining air with the gaseous fuel from the orifice.

Known gas burners with fans suffer several drawbacks. For example, the fans can be noisy. In a particular example, the gas burner described in U.S. Pat. No. 8,479,721 employs a variable speed fan that varies with a gas input in order to maintain proper fuel/air mixture throughout an operating range of the gas burner. The variable speed fan is costly and complex to operate. In addition, the gas burner is designed to operate with a high volume flow rate of fuel/air mixture and this inherently limits the gas burner's ability to operate efficiently with a low volume flow rate of fuel/air mixture. In another particular example, the gas burner described in U.S. Pat. No. 8,845,326 has a separate burner stage for lower outputs in the operating range of the gas burner. The separate burner stage requires a dual output valve which adds significant cost.

Accordingly, a gas burner with forced aeration that includes features for operating quietly over a majority of an operating range of the gas burner would be useful. In addition, a gas burner with forced aeration that does not require a variable speed fan in combination with fuel input across the operating range of the gas burner would be useful. Further, a gas burner with forced aeration that does not require a costly dual outlet control valve would be useful.

BRIEF DESCRIPTION OF THE INVENTION

The present subject matter provides a cooktop appliance with a gas burner assembly. The gas burner assembly includes one or more burner bodies that define a first plurality of flame ports, a first fuel chamber, a second plurality of flame ports and a second fuel chamber. A fan is coupled to the gas burner assembly such that the fan is operable to urge a flow of air into only the second fuel chamber. An operating speed of the fan is fixed such that a firing rate of the second plurality of flame ports is fixed. Additional aspects and advantages of the invention will be set forth in part in the following description, or may be apparent from the description, or may be learned through practice of the invention.

In a first example embodiment, a cooktop appliance is provided. The cooktop appliance includes a top panel. A gas burner assembly is positioned at the top panel. The gas burner assembly includes one or more burner bodies that define a first plurality of flame ports, a first fuel chamber, a second plurality of flame ports and a second fuel chamber. The first fuel chamber is in fluid communication with the first plurality of flame ports such that gaseous fuel within the first fuel chamber is flowable through the first plurality of flame ports. The second fuel chamber is in fluid communication with the second plurality of flame ports such that gaseous fuel within the second fuel chamber is flowable through the second plurality of flame ports. The first fuel chamber is separate from the second fuel chamber within the one or more burner bodies. A fan is coupled to the gas burner assembly such that the fan is operable to urge a flow of air into only the second fuel chamber. An operating speed of the fan is fixed such that a firing rate of the second plurality of flame ports is fixed.

In a second example embodiment, a cooktop appliance is provided. The cooktop appliance includes a top panel. A gas burner assembly is positioned at the top panel. The gas burner assembly includes one or more burner bodies that define a first plurality of flame ports, a first fuel chamber, a second plurality of flame ports and a second fuel chamber. The first fuel chamber is in fluid communication with the first plurality of flame ports such that gaseous fuel within the first fuel chamber is flowable through the first plurality of flame ports. The second fuel chamber is in fluid communication with the second plurality of flame ports such that gaseous fuel within the second fuel chamber is flowable through the second plurality of flame ports. The first fuel chamber is separate from the second fuel chamber within the one or more burner bodies. A fan is positioned below the top panel and is coupled to the gas burner assembly such that the fan is operable to urge a flow of air into only the second fuel chamber. An operating speed of the fan is fixed such that a firing rate of the second plurality of flame ports is fixed. The first plurality of flame ports is naturally aspirated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
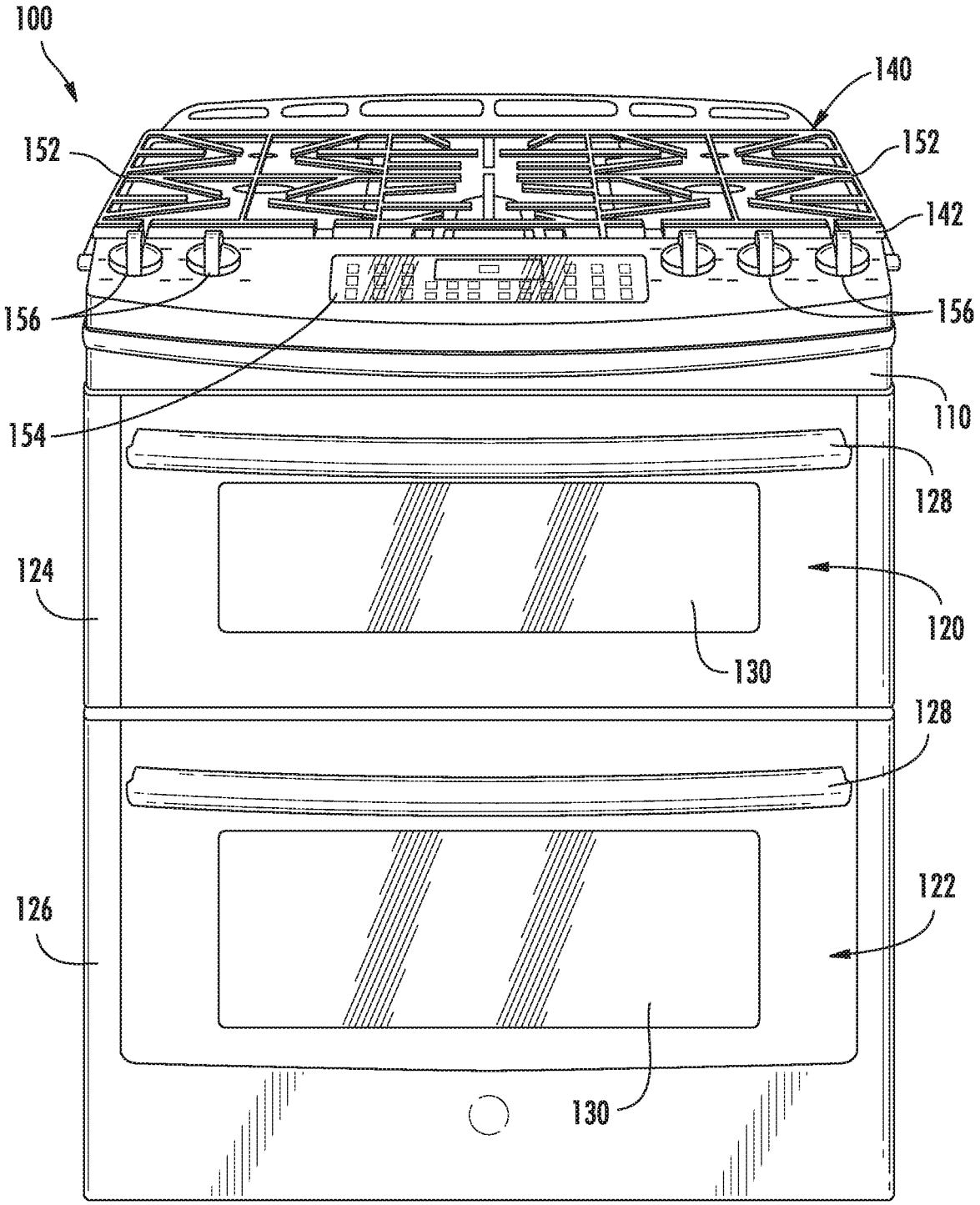
FIG. 1 is a front, perspective view of a range appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
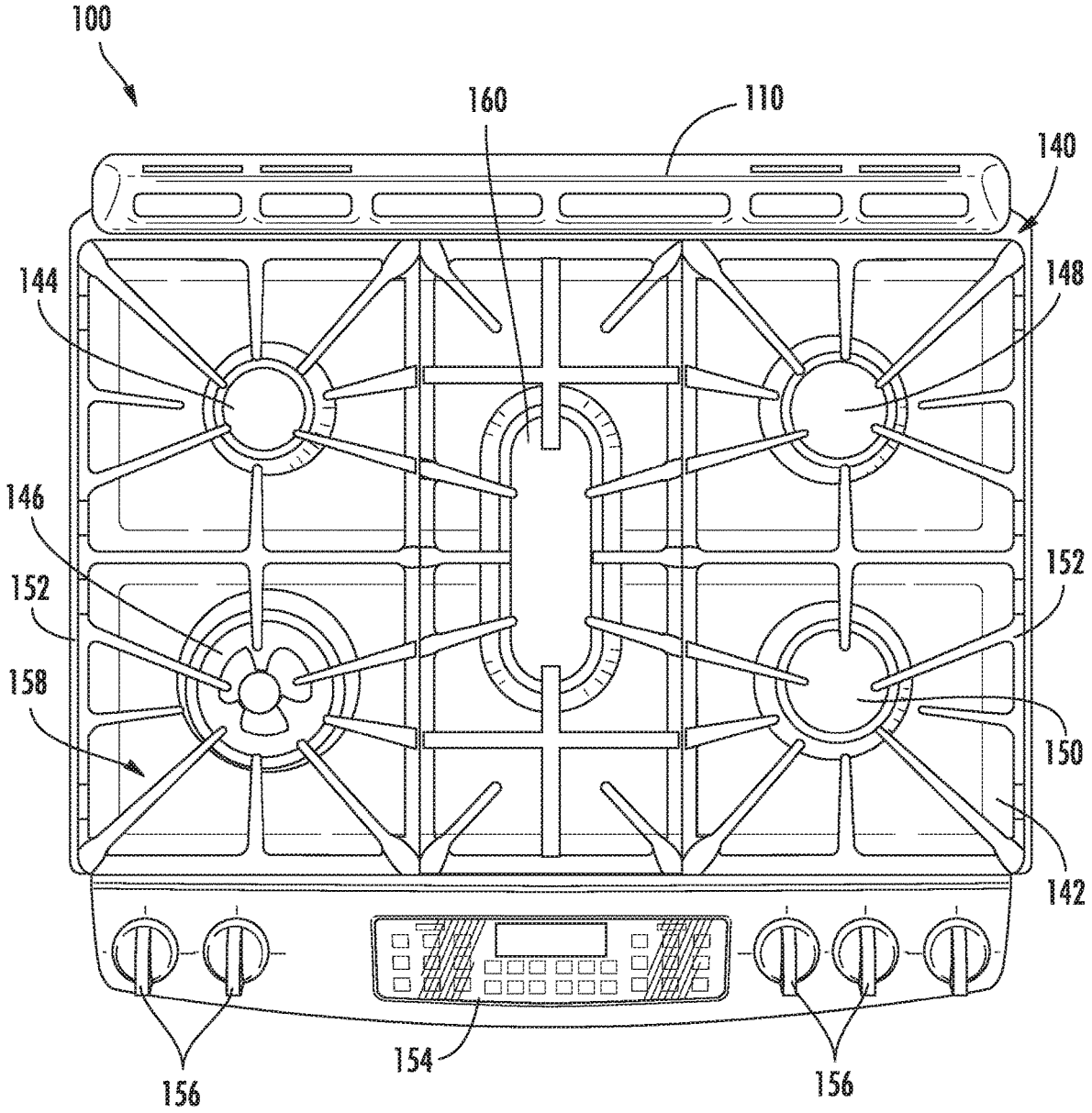
FIG. 2 is a top, plan view of the example range appliance of FIG. 1.

FIG. 1 provides a front, perspective view of a range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the example embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this example embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
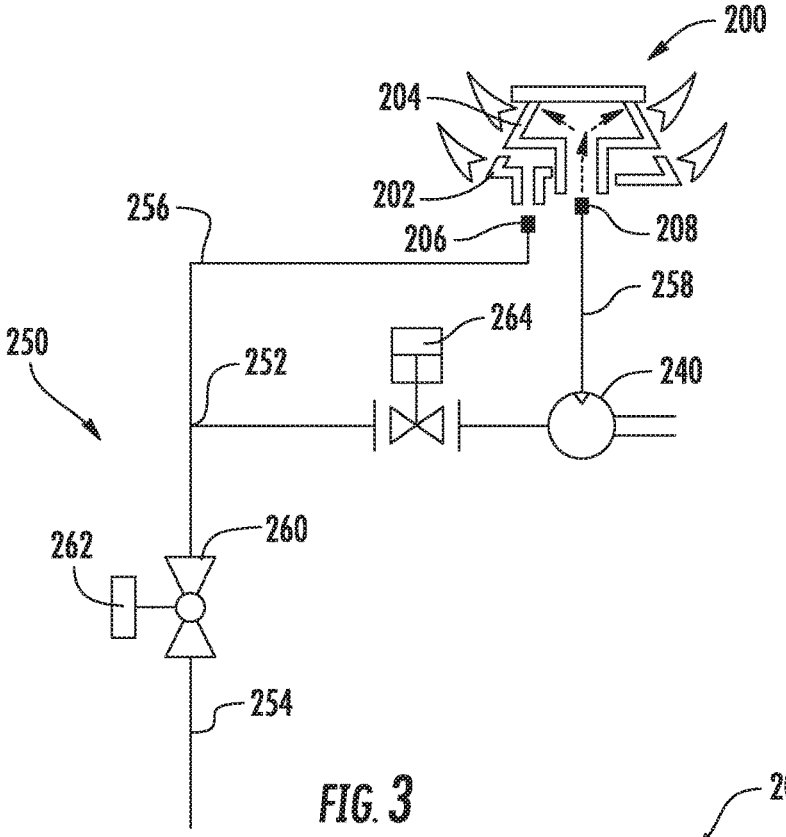
FIG. 3 is a schematic view of a gas burner assembly and a gaseous fuel supply circuit according to an example embodiment of the present subject matter.

FIG. 3 is a schematic view of a gas burner assembly 200 and a gaseous fuel supply circuit 250 according to an example embodiment of the present subject matter. As may be seen in FIG. 3, gas burner assembly 200 includes a first burner ring or stage 202 and a second burner ring or stage 204. Gaseous fuel supply circuit 250 is configured for selectively supplying gaseous fuel to gas burner assembly 200. In particular, gaseous fuel supply circuit 250 is configured for selectively supplying gaseous fuel to only first burner stage 202 or to both first and second burner stages 202, 204 depending upon the desired output of gas burner assembly 200 selected by a user of gas burner assembly 200. Thus, first burner stage 202 is separate or independent from second burner stage 204, e.g., such that first burner stage 202 is not in fluid communication with second burner stage 204 within gas burner assembly 200. In such manner, gaseous fuel within gas burner assembly 200 does not flow between first and second burner stages 202, 204.

As shown in FIG. 3, gaseous fuel supply circuit 250 includes a supply line 252, a control valve 260 and a solenoid valve 264. Supply line 252 may be coupled to a pressurized gaseous fuel source (not shown), such a natural gas supply line or a propane tank, such that gaseous fuel (e.g., natural gas or propane) is flowable from the pressurized gaseous fuel source into supply line 252. Supply line 252 has a trunk 254, a first branch 256 and a second branch 258. First branch 256 extends from trunk 254 to a first orifice 206, and second branch 258 extends from trunk 254 to a second orifice 208. Thus, trunk 254 may be positioned upstream of first and second branches 256, 258 relative to a flow of gaseous fuel from the fuel source, and first and second branches 256, 258 may be plumbed in parallel off trunk 254.

Gaseous fuel from the trunk 254 may flow to first and second branches 256, 258. From first branch, the gaseous fuel may flow to first orifice 206. First orifice 206 is positioned for directing gaseous fuel into gas burner assembly 200, more particularly to first burner stage 202. Second orifice 208 is also positioned for directing gaseous fuel into gas burner assembly 200, more particularly to second burner stage 204. Thus, first and second branches 256, 258 may separately supply the gaseous fuel from trunk 254 to first and second burner stages 202, 204.

Control valve 260 is coupled to trunk 254. Thus, control valve 260 may be positioned upstream of first and second branches 256, 258. Solenoid valve 264 is coupled to second branch 258, e.g., upstream of second orifice 208. Thus, solenoid valve 264 may be positioned between trunk 254 and second orifice 208. Control valve 260 is selectively adjustable to regulate gaseous fuel flow through trunk 254 to first and second branches 256, 258. Solenoid valve 264 is selectively adjustable to allow gaseous fuel flow through second branch 258 to second orifice 208. Control valve 260 and solenoid valve 264 cooperate to regulate gaseous fuel flow to first and second burner stages 202, 204, as discussed in greater detail below.

Control valve 260 includes a knob 262. A user may rotate knob 262 to adjust fuel flow through trunk 254 with control valve 260. In particular, gas burner assembly 200 may have a respective heat output at each position of knob 262. It will be understood that while described herein in the context of the positions of knob 262, the description also corresponds to the positions and/or configurations of control valve 260 for regulating operation of gas burner assembly 200.

Figure 8:
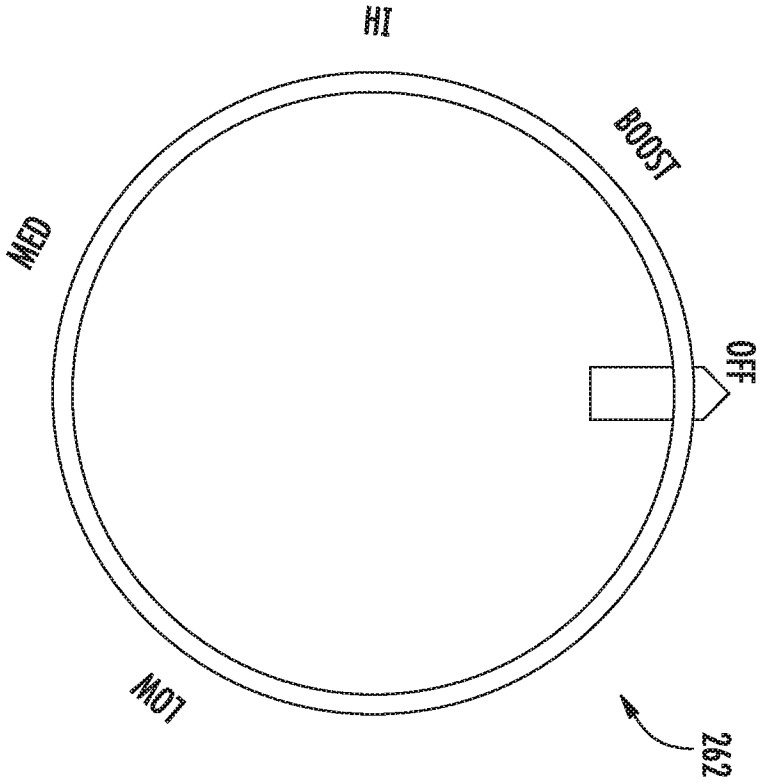
FIG. 8 is a front, elevation view of a knob of the example gaseous fuel supply circuit of FIG. 3.

FIG. 8 is a front, elevation view of knob 262 of gaseous fuel supply circuit 250. As shown in FIG. 8, knob 262 may be rotated between an off position, a low position, a medium position, a high position and a boost position. In the off position, control valve 260 blocks gaseous fuel flow through trunk 254 to first and second branches 256, 258. Thus, gas burner assembly 200 is not supplied with gaseous fuel from gaseous fuel supply circuit 250 when knob 262 is in the off position. Conversely, when knob 262 is in the low position, the medium position or the high position, control valve 260 permits gaseous fuel flow through trunk 254 to first and second branches 256, 258. Thus, first burner stage 202 is supplied with gaseous fuel from gaseous fuel supply circuit 250 when knob 262 is in the low position, the medium position or the high position. However, solenoid valve 264 is normally closed, and, more particularly, solenoid valve 264 is closed in the low position, the medium position or the high position. Thus, second burner stage 204 is not supplied with gaseous fuel from gaseous fuel supply circuit 250 when knob 262 is in the low position, the medium position or the high position. The flow rate of gaseous fuel through control valve 260 increases as knob 260 rotates from the low position to the medium position then to the high position. Thus, the output (e.g., in BTUs) of gas burner assembly 200 increases as knob 260 rotates from the low position to the medium position then to the high position.

As may be seen from the above, second burner stage 204 is not supplied with gaseous fuel from gaseous fuel supply circuit 250 when knob 262 is in the off position, the low position, the medium position or the high position. However, when knob 262 is in the boost position, control valve 260 permits gaseous fuel flow through trunk 254 to first and second branches 256, 258. Thus, first burner stage 202 is supplied with gaseous fuel from gaseous fuel supply circuit 250 when knob 262 is in the boost position. In addition, solenoid valve 264 is open in the boost position. Thus, second burner stage 204 is supplied with gaseous fuel from gaseous fuel supply circuit 250 when knob 262 is in the boost position. With both first and second burner stages 204 receiving and burning gaseous fuel, the output (e.g., in BTUs) of gas burner assembly 200 is higher when knob 262 is in the boost position relative to when knob 262 is in the high position.

With reference to FIG. 3, a fan 240 is operable to flow air into second burner stage 204. In particular, fan 240 may be deactivated and not flow air into second burner stage 204 when knob 262 is in the off position, the low position, the medium position or the high position. However, fan 240 may be activated and urge air into second burner stage 204 when knob 262 is in the boost position. Air from fan 240 may facilitate burning of gaseous fuel at second burner stage 204.

As may be seen from the above, first burner stage 202 is naturally aspirated and is activated when knob 262 is in the low position, the medium position, the high position or the boost position. In contrast, second burner stage 204 is force or mechanically aspirated and may be activated only when knob 262 is in the boost position. Thus, fan 240 may only be activated and thus make noise when knob 262 is in the boost position. Accordingly, gas burner assembly 200 may operate more quietly during relatively low heat outputs and may activate fan 240 and operate more nosily only when high heat outputs are desired.

In addition, an operating speed of fan 240 may be fixed or discrete, e.g., such that a firing rate of second burner stage 204 is fixed. Because fan 240 operates only when knob 262 is in the boost position, fan 240 may operate at a single speed (e.g., be a single speed fan). Thus, second burner stage 204 may be more easily controlled, e.g., because gas burner assembly 200 does not require a variable speed fan and/or an encoder. Further, outlet valve 260 may be a single outlet valve for both first and second burner stages 202, 204 and thus not reduce a cost and complexity of outlet valve 260 relative to multi-outlet valves.

Figure 4:
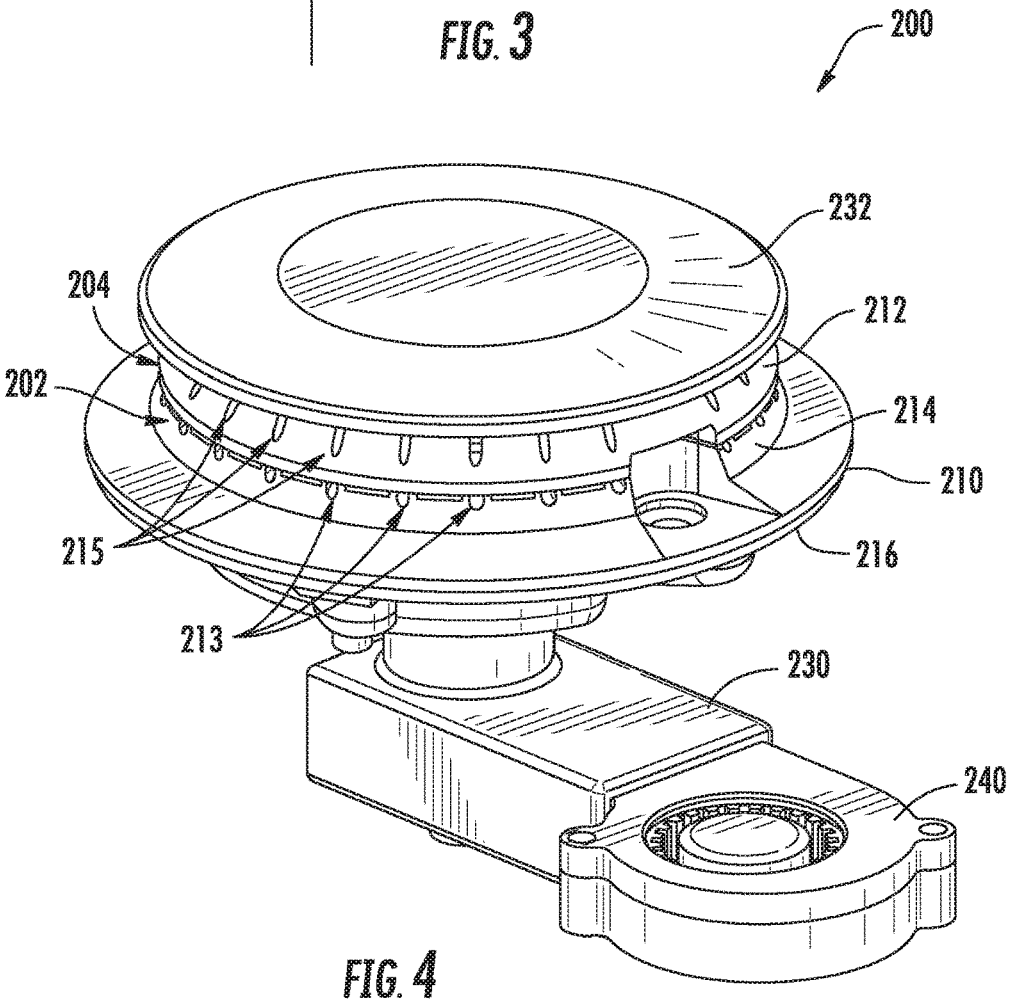
FIG. 4 is a perspective view of the example gas burner of FIG. 3.
Figure 5:
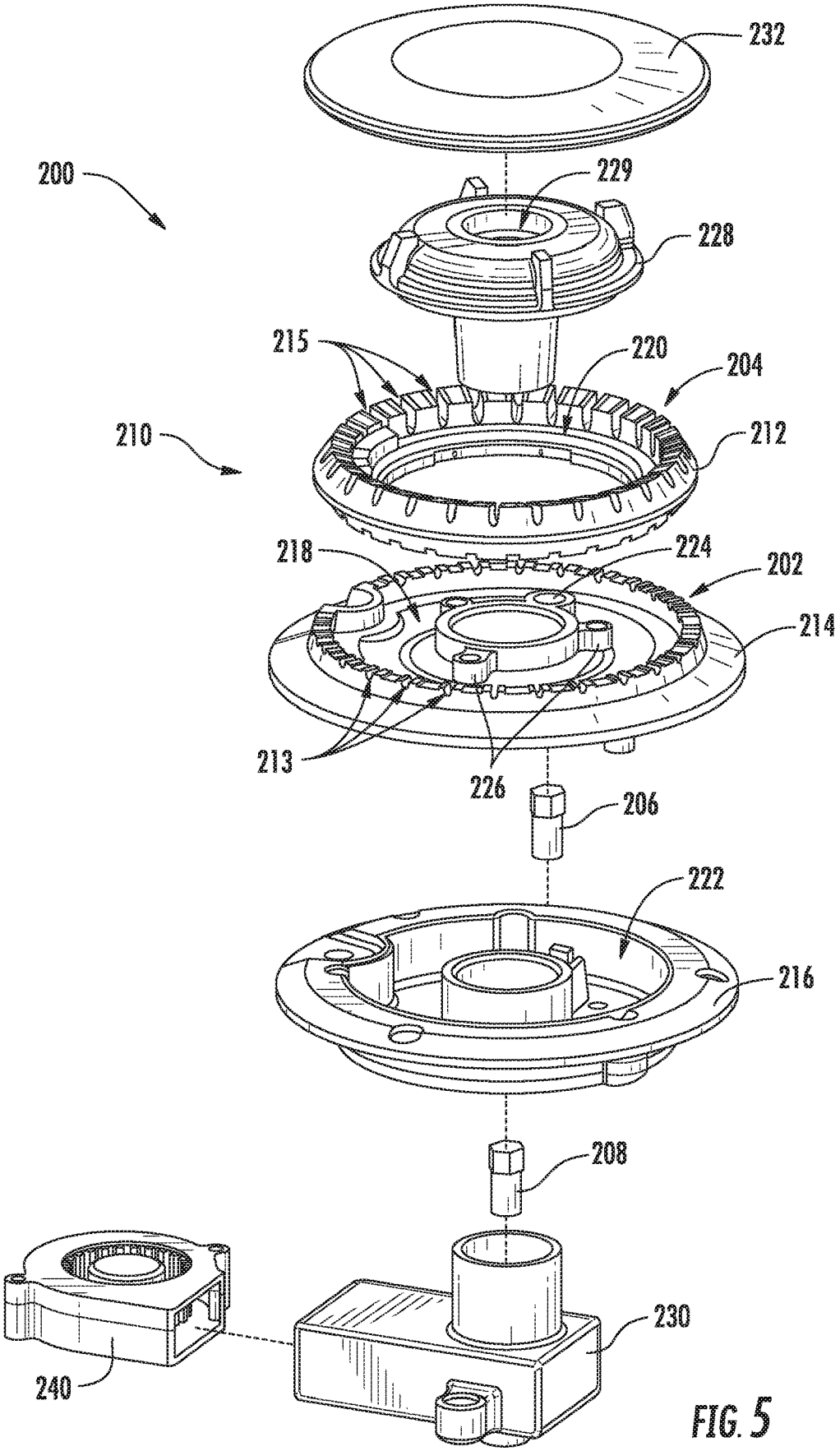
FIG. 5 is an exploded view of the example gas burner of FIG. 4.
Figure 6:
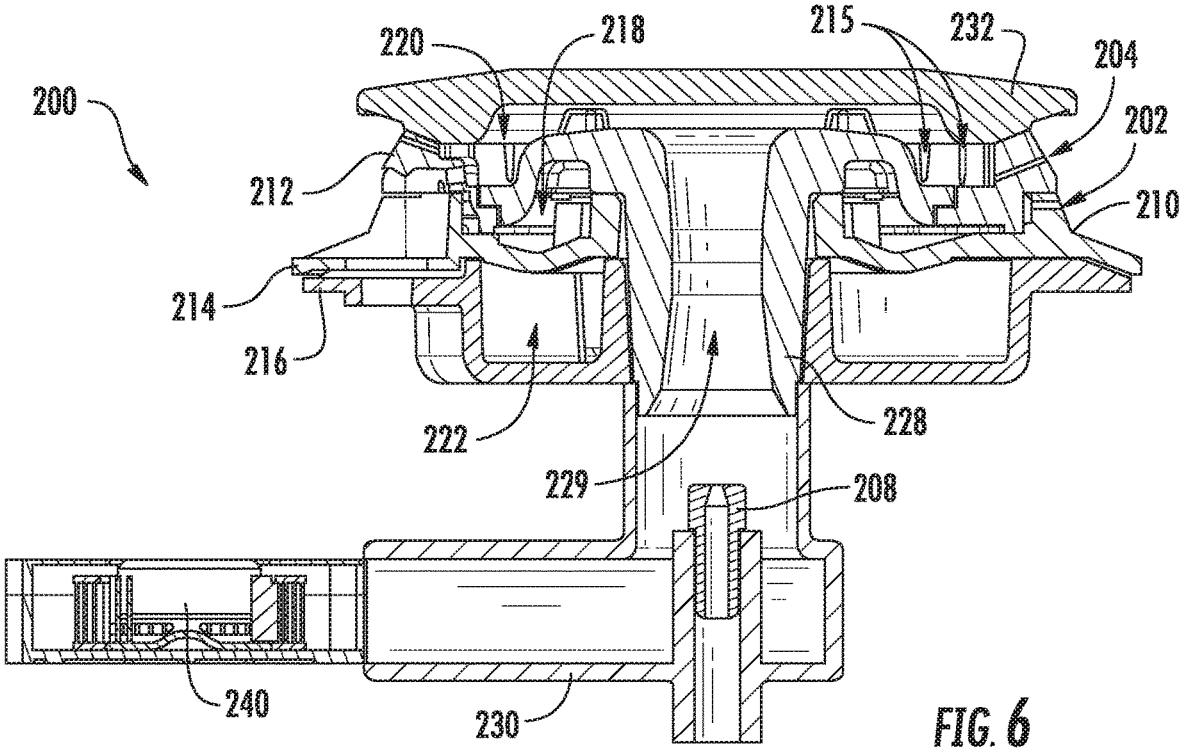
FIG. 6 is a section view of the example gas burner of FIG. 4.
Figure 7:
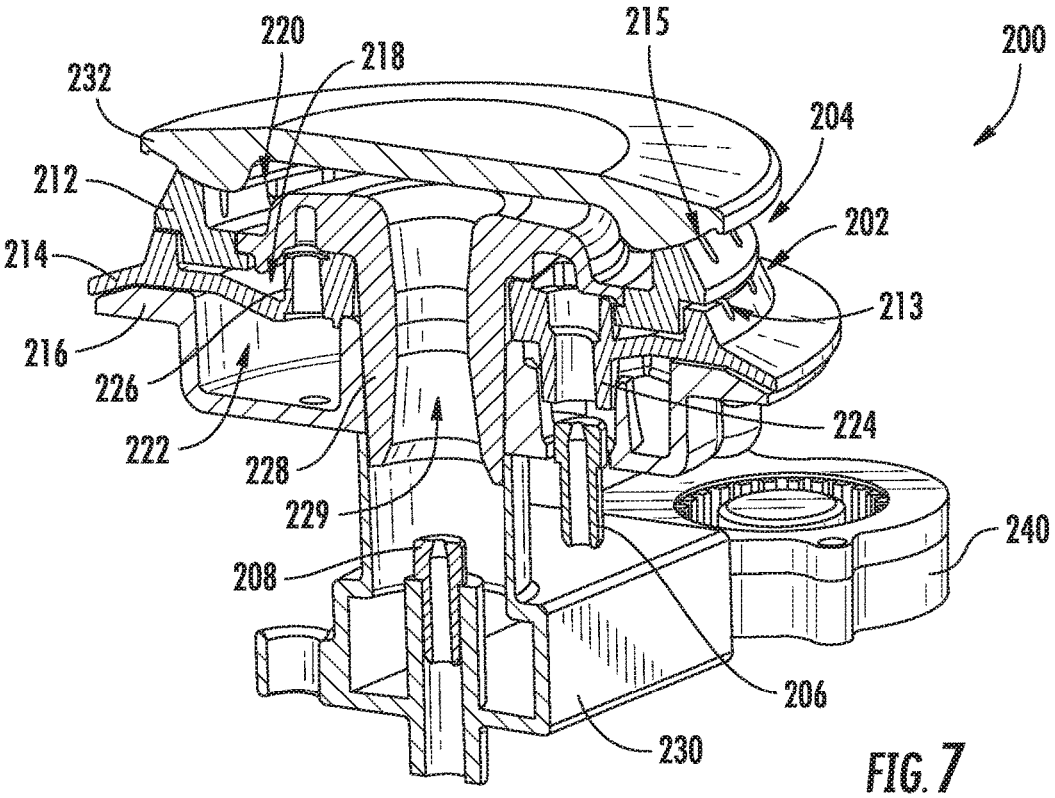
FIG. 7 is another section view of the example gas burner of FIG. 4.

FIG. 4 is a perspective view of gas burner assembly 200. FIG. 5 is an exploded view of gas burner assembly 200. FIG. 6 is a section view of the gas burner assembly 200, and FIG. 7 is another section view of gas burner assembly 200. As an example, burner assembly 200 may be used in range appliance 100 (FIG. 2) as one of burner assemblies 144, 146, 148, 150. However, it will be understood that, while describe in greater detail below in the context of range appliance 100, burner assembly 200 may be used in or with any suitable appliance in alternative example embodiments.

As may be seen in FIGS. 4 through 7, gas burner assembly 200 includes one or more burner bodies 210 that define a first plurality of flame ports 213, a first fuel chamber 218, a second plurality of flame ports 215 and a second fuel chamber 220. In particular, burner bodies 210 may include a first burner body 212, a second burner body 214 and a third burner body 216. Gas burner assembly 200 may also include an air duct 228, a manifold 230 and a cap 232. First plurality of flame ports 213 may be defined on second burner body 214, e.g., at a circular outer wall of second burner body 214. Similarly, second plurality of flame ports 215 may be defined on first burner body 212, e.g., at a circular outer wall of first burner body 212. Second fuel chamber 220 may be defined by inner surfaces of cap 232, air duct 228, and first burner body 212. First fuel chamber 218 may be defined by inner surfaces of air duct 228, first burner body 212 and second burner body 214. First fuel chamber 218 is separate or independent from second fuel chamber 220 within gas burner assembly 200. Thus, first fuel chamber 218 is not in flow communication with second fuel chamber 220 within gas burner assembly 200. An air chamber 222 may be defined by second burner body 214 and third burner body 216.

Fan 240 is mounted to manifold 230. Thus, e.g., fan 240 is operable to urge air into manifold 230. Second orifice 208 is also mounted to manifold 230. Thus, gaseous fuel from second orifice 208 may flow into manifold 230 and mix with air from fan 240. Manifold 230 also extends to air duct 228. A passage 229 of air duct 228 extends from manifold 230 to second fuel chamber 220. Thus, the mixture of gaseous fuel and air from manifold 230 may flow through passage 229 of air duct 228 to second fuel chamber 220. Second orifice 208 may be positioned directly below and/or concentric with passage 229 of air duct 228. From second fuel chamber 220, the mixture of gaseous fuel and air may flow through and be combusted at second plurality of flame ports 211. Thus, second plurality of flame ports 215 are in fluid communication with second fuel chamber 220 such that the mixture of gaseous fuel and air within second fuel chamber 220 is flowable through second plurality of flame ports 215. As may be seen from the above, fan 240 may be coupled to gas burner assembly 200 such that fan 240 is operable to urge a flow of air into only second fuel chamber 220, and fan 240 may provide air to second fuel chamber 220 for forced aspiration of second burner stage 204.

As may be seen in FIG. 7, first orifice 206 is positioned at, e.g., directly below and/or concentric with, a Venturi inlet passage 224 on second burner body 214. Venturi inlet passage 224 is in fluid communication with first fuel chamber 218. Thus, gaseous fuel from first orifice 206 may flow into first fuel chamber 218 through Venturi inlet passage 224. From first fuel chamber 218, the mixture of gaseous fuel and air may flow through and be combusted at first plurality of flame ports 213. Thus, first plurality of flame ports 213 are in fluid communication with first fuel chamber 218 such that the mixture of gaseous fuel and air within first fuel chamber 218 is flowable through first plurality of flame ports 213.

Venturi inlet passage 224 assists with naturally aspirating first burner stage 202. For example, Venturi inlet passage 224 may increase a speed and/or decrease a pressure of gaseous fuel flowing from first orifice 206 such that Venturi inlet passage 224 entrains air from air chamber 222 into Venturi inlet passage 224. Inlet passages 226 may also extend between and provide fluid communication between first fuel chamber 218 and air chamber 222. Thus, air from air chamber 222 may flow into and mix with gaseous fuel within first fuel chamber 218 through inlet passages 226.

As may be seen in FIG. 4, first plurality of flame ports 213 may be positioned concentric with second plurality of flame ports 215. Further, first plurality of flame ports 213 (and first burner stage 202) may be positioned below second plurality of flame ports 215 (and second burner stage 204). Such positioning of first burner stage 202 relative to second burner stage 204 may improve combustion of gaseous fuel when knob 262 is in the boost position. For example, flames at first burner stage 202 may assist with lighting gaseous fuel at second burner stage 204 when knob 262 is in the boost position due to the position of first burner stage 202 below second burner stage 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance, comprising:

a top panel;

a gas burner assembly positioned at the top panel, the gas burner assembly comprising one or more burner bodies defining a first plurality of flame ports, a first fuel chamber, a second plurality of flame ports and a second fuel chamber, the first fuel chamber in fluid communication with the first plurality of flame ports such that gaseous fuel within the first fuel chamber is flowable through the first plurality of flame ports, the second fuel chamber in fluid communication with the second plurality of flame ports such that gaseous fuel within the second fuel chamber is flowable through the second plurality of flame ports, the first fuel chamber separate from the second fuel chamber within the one or more burner bodies;

a single speed fan coupled to the gas burner assembly such that the single speed fan is operable to urge a flow of air into only the second fuel chamber;

a supply line having a trunk, a first branch and a second branch, the first branch extending from the trunk to a first orifice, the second branch extending from the trunk to a second orifice, the first orifice positioned for directing the gaseous fuel into the first chamber, the second orifice positioned for directing the gaseous fuel into the second chamber; a single outlet control valve coupled to the trunk to regulate gaseous fuel flow to the first and second branches; and a solenoid valve coupled to the second branch between the trunk and the second orifice, wherein an operating speed of the single speed fan is fixed such that a firing rate of the second plurality of flame ports is fixed;

wherein the first plurality of flame ports is positioned below the second plurality of flame ports.

2. The cooktop appliance of claim 1, wherein the solenoid valve is normally closed and is openable in response to the single outlet control valve shifting to a boost configuration and to the single speed fan activating.

3. The cooktop appliance of claim 1, wherein the single outlet control valve and the solenoid valve permit gaseous fuel flow to both the first and second fuel chambers when the single outlet control valve is in a boost configuration.

4. The cooktop appliance of claim 3, wherein the single outlet control valve and the solenoid valve permit gaseous fuel flow to only the first fuel chamber when the single outlet control valve in not in the boost configuration.

5. The cooktop appliance of claim 1, wherein the first plurality of flame ports is positioned concentric with the second plurality of flame ports.

6. The cooktop appliance of claim 1, wherein the single speed fan is positioned below the top panel.

7. A cooktop appliance, comprising:

a top panel;

a gas burner assembly positioned at the top panel, the gas burner assembly comprising one or more burner bodies defining a first plurality of flame ports, a first fuel chamber, a second plurality of flame ports and a second fuel chamber, the first fuel chamber in fluid communication with the first plurality of flame ports such that gaseous fuel within the first fuel chamber is flowable through the first plurality of flame ports, the second fuel chamber in fluid communication with the second plurality of flame ports such that gaseous fuel within the second fuel chamber is flowable through the second plurality of flame ports, the first fuel chamber separate from the second fuel chamber within the one or more burner bodies; and a single speed fan positioned below the top panel and coupled to the gas burner assembly such that the single speed fan is operable to urge a flow of air into only the second fuel chamber, a supply line having a trunk, a first branch and a second branch, the first branch extending from the trunk to a first orifice, the second branch extending from the trunk to a second orifice, the first orifice positioned for directing the gaseous fuel into the first chamber, the second orifice positioned for directing the gaseous fuel into the second chamber;

a single outlet control valve coupled to the trunk to regulate gaseous fuel flow to the first and second branches; and a solenoid valve coupled to the second branch between the trunk and the second orifice;

wherein an operating speed of the single speed fan is fixed such that a firing rate of the second plurality of flame ports is fixed, and wherein the first plurality of flame ports is naturally aspirated, wherein the first plurality of flame ports is positioned concentric with the second plurality of flame ports.

8. The cooktop appliance of claim 7, wherein the solenoid valve is normally closed and is openable in response to the single outlet control valve shifting to a boost configuration and to the single speed fan activating.

9. The cooktop appliance of claim 7, wherein the single outlet control valve and the solenoid valve permit gaseous fuel flow to both the first and second fuel chambers when the single outlet control valve is in a boost configuration.

10. The cooktop appliance of claim 9, wherein the single outlet control valve and the solenoid valve permit gaseous fuel flow to only the first fuel chamber when the single outlet control valve in not in the boost configuration.

11. The cooktop appliance of claim 7, wherein the first plurality of flame ports is positioned below the second plurality of flame ports.

* * * * *